US006508221B2

(12) United States Patent
Pater

(10) Patent No.: US 6,508,221 B2
(45) Date of Patent: Jan. 21, 2003

(54) LIQUID COOLED CROSS FLOW CYLINDER HEAD FOR INTERNAL COMBUSTION ENGINES WITH CYLINDERS ARRANGED IN SERIES

(75) Inventor: Piet Pater, Moosburg (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 09/730,729

(22) Filed: Dec. 7, 2000

(65) Prior Publication Data

US 2001/0015183 A1 Aug. 23, 2001

(30) Foreign Application Priority Data

Feb. 17, 2000 (DE) ..... 100 07 151

(51) Int. Cl.[7] ..... F02F 1/40
(52) U.S. Cl. ..... 123/193.5
(58) Field of Search ..... 123/193.5, 193.3, 123/193.1, 41.82 R, 41.84

(56) References Cited

U.S. PATENT DOCUMENTS

| | | | | |
|---|---|---|---|---|
| 3,491,731 A | | 1/1970 | Dinger et al. | |
| 4,291,650 A | * | 9/1981 | Formia et al. | 123/193.5 |
| 4,641,609 A | * | 2/1987 | Tanaka | 123/193.5 |
| 4,785,773 A | * | 11/1988 | Schreiber et al. | 123/193.5 |
| 4,889,079 A | | 12/1989 | Takeda et al. | 123/41.82 R |
| 4,951,622 A | * | 8/1990 | Takahashi et al. | 123/193.5 |
| 5,038,732 A | * | 8/1991 | Matayoshi et al. | 123/193.5 |

FOREIGN PATENT DOCUMENTS

| | | | |
|---|---|---|---|
| CH | 413 495 A | 5/1966 | F02F/1/42 |
| DE | 814 685 | 9/1951 | |
| DE | 1 476 397 | 5/1969 | |
| DE | 35 43 443 | 6/1986 | |
| DE | 38 38 953 | 5/1989 | |

OTHER PUBLICATIONS

European Patent Office Search Report.

* cited by examiner

*Primary Examiner*—Marguerite McMahon
(74) *Attorney, Agent, or Firm*—Crowell & Moring LLP

(57) ABSTRACT

For the purpose of achieving a simple casting design that exhibits high rigidity and specific coolant guide, it is proposed for a liquid cooled cross flow cylinder head, which is intended for internal combustion engines with cylinders arranged in series and comprises a coolant chamber, which is closed against an integrated control housing by means of a cover wall, that the cover wall exhibit a cavity between diametrical screw pipes and shaft tubes, which adjoin at right angles, for spark plugs or injection nozzles. Said cavity is connected to the cylinder head bottom by a cross wall between the diametrical screw pipes. The cavity's wall segments that ascend from the cross wall in the direction of the cover wall serve as the flow guide surfaces.

12 Claims, 2 Drawing Sheets

LIQUID COOLED CROSS FLOW CYLINDER HEAD FOR INTERNAL COMBUSTION ENGINES WITH CYLINDERS ARRANGED IN SERIES

BACKGROUND AND SUMMARY OF THE INVENTION

This application claims the priority of German Patent Document 100 07 151.1, filed in Germany, Feb. 17, 2000, the disclosures of which is expressly incorporated by reference herein.

The invention relates to a liquid cooled cross flow cylinder head for internal combustion engines with cylinders arranged in series, wherein the cylinder head with integrated control housing comprises a coolant chamber, defined by side walls, between a cylinder head bottom and a control housing-sided cover wall. The screw pipes, which penetrate the coolant chamber and the cover wall starting from the cylinder head bottom, as well as oil outlet channels and shaft tubes, arranged approximately in the center of the cylinder, are provided for spark plugs or injection nozzles. Furthermore, the coolant chamber is divided by cross walls between diametrical screw pipes.

Such a cylinder head is known, for example, from the German Patent Document No. DE 38 38 953 C2, where the cross walls, which are located between the diametrical screw pipes and penetrate the coolant chamber so as to follow its height up to the planar cover wall and further to the cross walls in the connecting planes of shaft tubes, adjoining at right angles, are provided in front of the longitudinal walls, which end the shaft tubes and which for a cross flow of the cylinder head serve to divert the coolant in the direction of the shaft tubes and the adjacent areas of the cylinder head bottom, which is provided with additional guide ribs.

The drawback with this known cylinder head is the complicated casting structure and the very large coolant chamber design.

The invention is based on the problem of designing this class of cylinder head by simple casting technology in such a manner that there is high rigidity and the coolant is guided specifically at least in cross flow.

This problem is solved according to the invention in that the cover wall exhibits a cavity between diametrical screw pipes and shaft tubes, which adjoin at right angles, which cavity is connected to the cylinder head bottom by a cross wall between the diametrical screw pipes. The cavity's wall segments that ascend from the cross wall in the direction of the cover wall serve as the flow guide surfaces.

With the invention, an especially rigid cylinder head is achieved in an advantageous manner in that the cavity, connected by cross walls to the cylinder head bottom, constitutes a simpler casting design. In another advantageous manner, better venting of the cylinder head is achieved with the omission of special guide ribs for influencing the flow.

According to the invention, the cavities for a cylinder head can be designed as a separate component. However, in a further development of the invention they are preferably cast as one piece so that, when viewed from the top, a cavity expands, starting from each screw pipe, in the direction of a connecting plane of the shaft tubes, which adjoin at right angles, and serves to direct the flow in the direction of the shaft tubes.

The aforementioned measures preferably support coolant cross flow in the cylinder head. In another design of the invention a longitudinal flow can also be achieved in that the cross wall between the cylinder head bottom and the cavity exhibits a flow passage in the longitudinal direction of the cylinder head. In this manner additional oncoming flow in the vicinity of the bottom of the shaft tubes can be achieved.

To drain the lubricating oil, which flows from the control housing of the cylinder head into a cavity, another proposal provides that the cavity is connected by a separate channel to the oil outlet channel. In another design an inlet opening of the separate channel is arranged in the cavity in accordance with the installation position of the cylinder head. Thus, the circulating quantity of lubricating oil is kept low; and unnecessary heating is avoided.

Finally the invention achieves an additional reinforcement of the cylinder head in that the cavity exhibits along its opening rim a reinforcement leg, which projects beyond the cover wall. This arrangement achieves by an advantageous casting method that reinforcement legs run transversely to the longitudinally positioned cylinder head between the screw pipes. According to the inventive shape of the cavity, the reinforcement legs extend in the shape of a V beyond the cylinder head and thus additionally reinforce it both in the cross and the longitudinal direction.

Other objects, advantages and novel features of the present invention will become apparent from the following detailed description of the invention when considered in conjunction with the accompanying drawings.

DETAILED DESCRIPTION OF THE DRAWINGS

Figure 1:
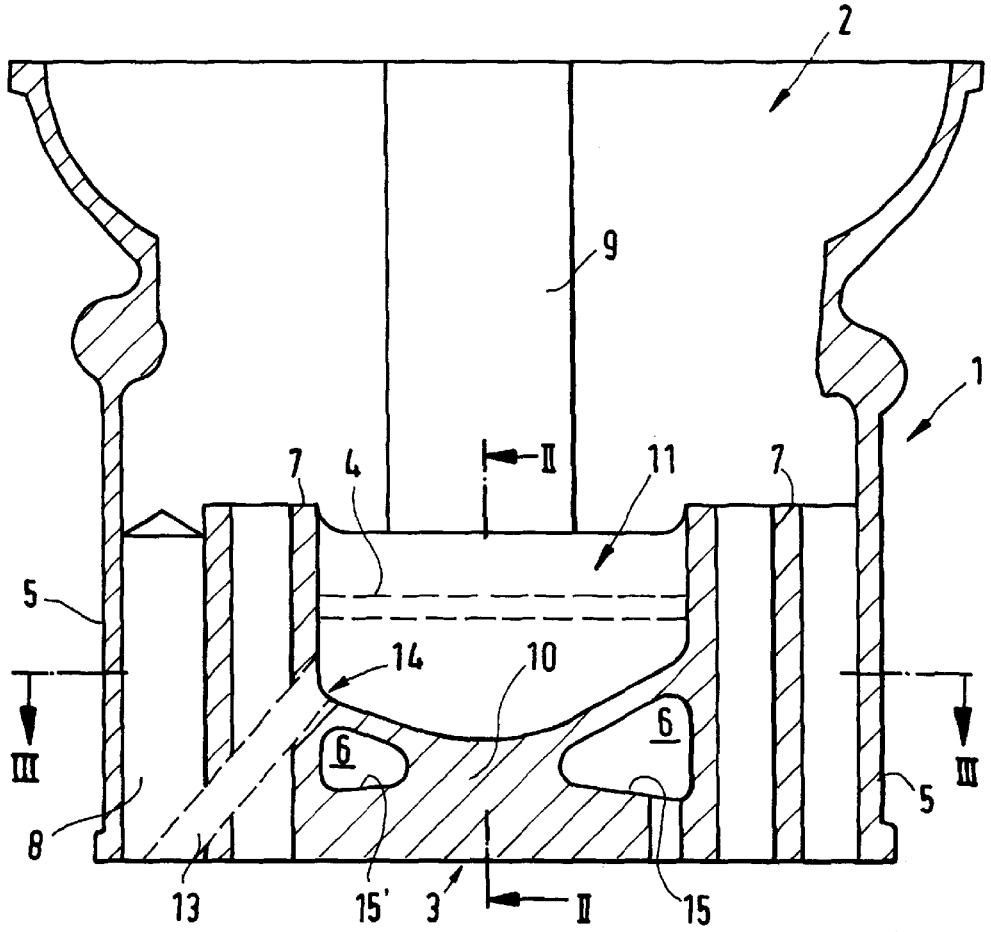
FIG. 1 is a cross sectional view of a cylinder head with integrated control housing, constructed according to a preferred embodiment of the invention.

A liquid cooled cross flow cylinder head 1 for an internal combustion engine (not illustrated) with cylinders, connected in series, comprises an integrated control housing 2 defined by cover walls 5 and a coolant chamber 6, between a cylinder head bottom 3 and a control housing cover wall 4. Furthermore, the cylinder head 1 is designed in such a manner that screw pipes 7, penetrating the coolant chamber 6 and the cover wall 4 starting from the cylinder head bottom 3, as well as oil outlet channels 8 and shaft tubes 9, which are arranged approximately in the center of the cylinder, are provided for spark plugs or injection nozzles. Furthermore, the coolant chamber 6 is divided by cross walls 10 between diametrical screw pipes 7.

With respect to the simplified casting design of the cylinder head 1 with high rigidity and specific coolant guide it is proposed that there be a cavity 11 in the cover wall 4 between the diametrical screw pipes 7 and the respective shaft tubes 9, which adjoin at right angles. Said cavity is connected by means of a cross wall 10 between the diametrical screw pipes 7 and the cylinder head bottom 3. The wall segments 11' and 11", which ascend from the cross wall 10 in the direction of the cover wall 4 and belong to the cavity 11, serve as the flow guide surfaces.

Figure 2:
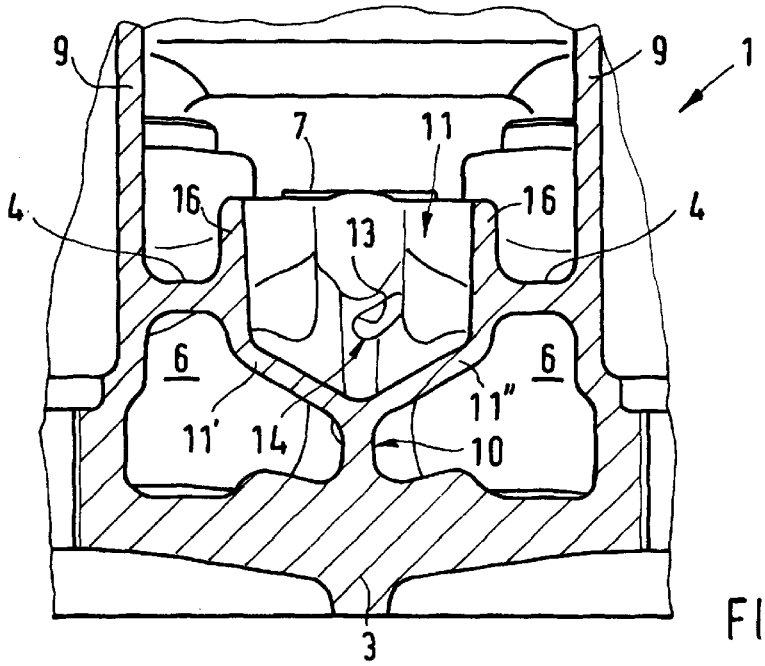
FIG. 2 is a longitudinal view of a detail of the cylinder head along the line II—II.

As apparent from FIGS. 1 and 2, the cavity 11, made by casting as one piece, is arranged in the cylinder head 1. When viewed from the top, the cavity 11 expands from each screw pipe 7 in the direction of a connecting plane 12—FIG. 3—of the shaft tubes 9, which adjoin at right angles, and serves to direct the flow in the direction of the shaft tubes 9.

To drain the lubricating oil reliably from the control housing 2 into the cavity 11, the cavity 11 is connected by means of a separate channel 13 to the oil outlet channel 8 or 8'.

According to FIG. 1, the cavity 11 is connected to the oil outlet channel 8, designed as one piece with a screw pipe 7, by means of a channel 13, penetrating the screw pipe 7. In this respect the screw pipe 7 encloses with play a cylinder head screw (not illustrated).

To avoid higher quantities of residual lubricating oil, an inlet opening 14 of the separate channel 11 is arranged in the cavity 11 in accordance with the installation position of the cylinder head 1.

Figures 3, 3A, 3B:
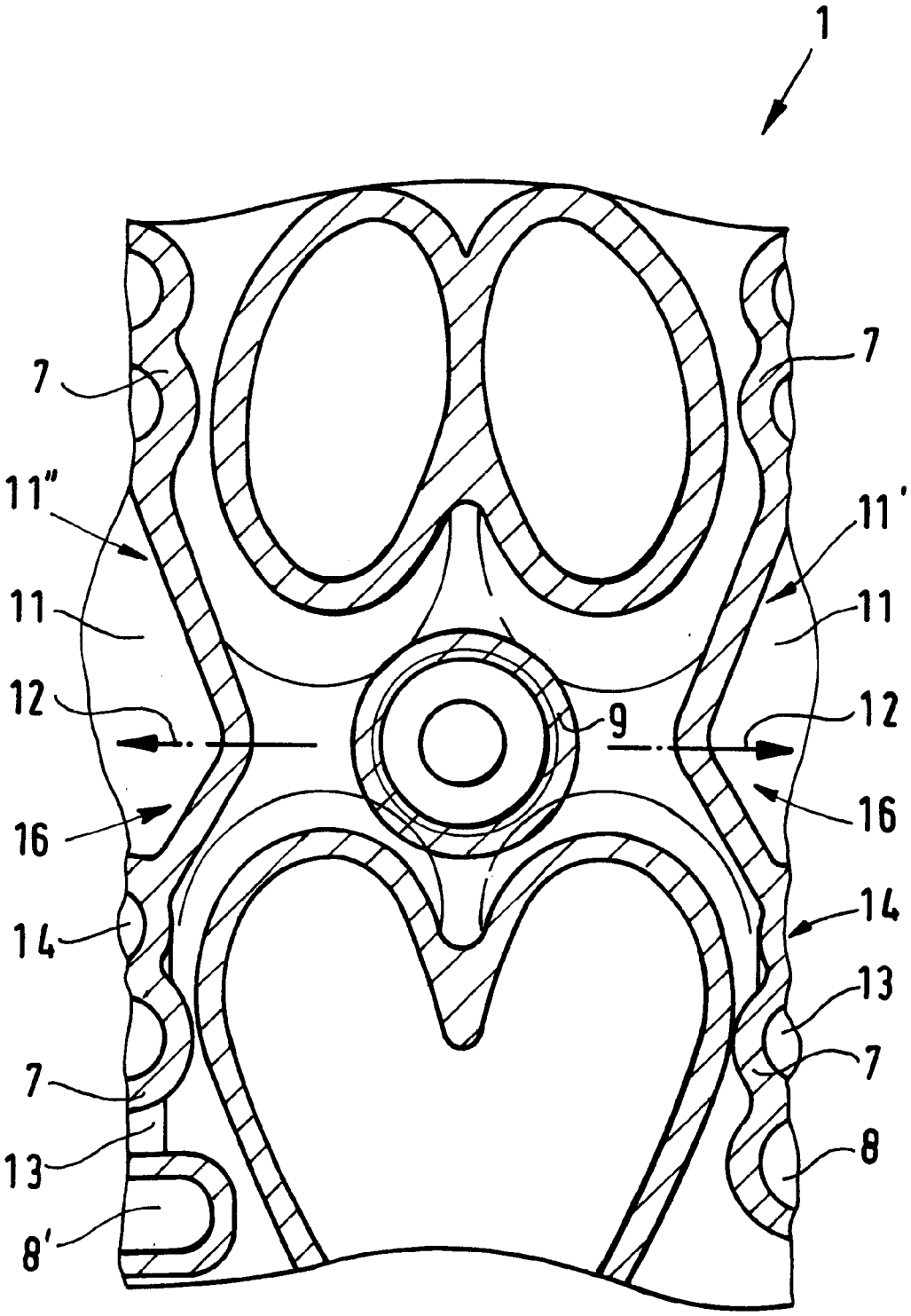
FIG. 3 is a cross sectional view of the cylinder head of FIG. 1 along the line III—III, and the Figure sections 3*a* and 3*b* depict diverse oil outlet channels.

As evident from FIG. 3, FIG. 2*a* shows an oil outlet channel 8 designed as one piece with a screw pipe 7, whereas FIG. 3*b* shows an oil outlet channel 8', which is arranged free standing from the screw pipe 7.

Furthermore, it is apparent from FIG. 1 that the cross wall 10 between cylinder head bottom 3 and cavity 11 exhibits flow passages 15 and 15' pointing in the longitudinal direction of the cylinder head 1. Thus, the cross flow can be complemented by a longitudinal flow of the coolant.

Finally an additional reinforcement of the cylinder head 1 is achieved in that the cavity 11 exhibits along its opening rim a reinforcement leg 16, which projects beyond the cover wall 4. Since each reinforcement leg 16 in its course transversely over the cylinder head 1 follows approximately the course of the wall segments 11' and 11" of the cavity 11, shown in FIG. 3, each of the reinforcement legs 16 contributes to the reinforcement of the cylinder head 1 in the longitudinal and cross direction.

The invention is appropriate for two valve and multivalve cylinder heads for series or V engines.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A cylinder head for an internal combustion engine which has a plurality of aligned cylinders, comprising:

a cylinder head bottom, a control housing cover wall extending above the head bottom, screw pipes extending from the cylinder head bottom and penetrating the control housing cover wall, an oil outlet channel extending upwardly from the cylinder head bottom, shaft tube openings disposed centrally for accommodating at least one of igniters and injection nozzles, a coolant chamber defined in part by the control housing cover wall, said coolant chamber extending adjacent the shaft tube opening, a cross wall dividing the coolant chamber and extending between a pair of the screw pipe openings, and a cavity between the pair of the screw pipe openings, said cavity being formed by wall segments extending downwardly from the control housing cover wall to the cross wall, said wall segments being configured as flow guide surfaces of the coolant chamber.

2. Cylinder head as claimed in claim 1, wherein the cavity is of a cast one-piece design, which, when viewed from the top, expands from each screw pipe in a direction of a connecting plane of the shaft tubes, adjoining at right angles, and serves to direct the flow in the direction of the shaft tubes.

3. Cylinder head as claimed in claim 2, wherein the cavity is connected by a separate channel to the oil outlet channel.

4. Cylinder head as claimed in claim 3, wherein an inlet opening of the separate channel is arranged in the cavity in accordance with the installation position of the cylinder head.

5. Cylinder head as claimed in claim 3, wherein the cavity is connected to the oil outlet channel, designed as one piece with a screw pipe, by means of the separate channel, penetrating the one piece with the screw pipe, and wherein the screw pipe encloses with play a cylinder head screw.

6. Cylinder head as claimed in claim 2, wherein the cavity is connected to the oil outlet channel, designed as one piece with a screw pipe, by means of a channel, penetrating the one piece with a screw pipe, and wherein the screw pipe encloses with play a cylinder head screw.

7. Cylinder head as claimed in claim 6, wherein an inlet opening of the separate channel is arranged in the cavity in accordance with the installation position of the cylinder head.

8. Cylinder head as claimed in claim 1, wherein the cross wall between the cylinder head bottom and the cavity exhibits a flow passage pointing in a longitudinal direction of the cylinder head.

9. A cylinder head according to claim 8, wherein the cylinder head is a one-piece cast part including the cylinder head bottom, the central housing cover wall, the cavity, the screw pipes and the shaft tube opening.

10. Cylinder head as claimed in claim 1, wherein the cavity exhibits cavity a reinforcement leg, which projects along an opening rim of the beyond the cover wall.

11. A cylinder head according to claim 10, wherein the cylinder head is a one-piece cast part including the cylinder head bottom, the central housing cover wall, the cavity, the screw pipes and the shaft tube opening.

12. A cylinder head according to claim 1, wherein the cylinder head is a one-piece cast part including the cylinder head bottom, the central housing cover wall, the cavity, the screw pipes and the shaft tube opening.

* * * * *